US006786331B1

(12) United States Patent
Zucchini

(10) Patent No.: US 6,786,331 B1
(45) Date of Patent: Sep. 7, 2004

(54) FOLDING LEAFLET FOR CIGARETTE AND OTHER PRODUCT PACKETS

(75) Inventor: Franco Zucchini, Sarzana (IT)

(73) Assignee: Effezeta International S.r.l., Sarzana (IT)

( * ) Notice: Subject to any disclaimer, the term of this patent is extended or adjusted under 35 U.S.C. 154(b) by 0 days.

(21) Appl. No.: 10/110,686

(22) PCT Filed: Feb. 21, 2000

(86) PCT No.: PCT/IT00/00054

§ 371 (c)(1),
(2), (4) Date: Jun. 25, 2002

(87) PCT Pub. No.: WO01/28870

PCT Pub. Date: Apr. 26, 2001

(30) Foreign Application Priority Data

Oct. 18, 1999 (IT) ..... PI99A0067

(51) Int. Cl.[7] ..... B65D 69/00
(52) U.S. Cl. ..... 206/232; 206/831; 206/273
(58) Field of Search ..... 206/232, 457, 206/459.5, 268, 273, 831; 229/160.1

(56) References Cited

U.S. PATENT DOCUMENTS

| | | | | |
|---|---|---|---|---|
| 1,116,043 A | * | 11/1914 | Elliott | 229/125.37 |
| 3,695,422 A | | 10/1972 | Tripodi | |
| 4,351,679 A | | 9/1982 | Dreher | |
| 4,425,181 A | | 1/1984 | Bahr et al. | |
| 4,779,733 A | | 10/1988 | Kilian | |
| 4,834,240 A | | 5/1989 | Dagostine | |
| 4,838,424 A | | 6/1989 | Petzelt | |
| 4,872,555 A | | 10/1989 | Shadrach, III et al. | |
| 5,035,935 A | | 7/1991 | Thomas et al. | |
| 5,038,930 A | | 8/1991 | Holtkamp, Jr. | |
| 5,074,462 A | | 12/1991 | Countee, Jr. | |
| 5,127,676 A | | 7/1992 | Bockairo | |
| 5,137,148 A | | 8/1992 | Evers | |
| 5,232,087 A | | 8/1993 | Schluger | |
| 5,236,084 A | | 8/1993 | Evers | |
| 5,289,917 A | | 3/1994 | Chabria | |
| 5,293,994 A | * | 3/1994 | Antik | 206/387.1 |
| 5,363,955 A | | 11/1994 | Fleenor | |
| 5,433,317 A | | 7/1995 | Roser | |
| 5,458,235 A | | 10/1995 | Stone | |
| 5,820,165 A | | 10/1998 | Verenski | |
| 6,003,903 A | | 12/1999 | Verenski | |
| 6,053,325 A | | 4/2000 | Yonker et al. | |
| 6,068,115 A | | 5/2000 | Boulton | |

FOREIGN PATENT DOCUMENTS

| | | |
|---|---|---|
| DE | 25 16 720 A | 10/1976 |
| WO | 97 19860 A | 6/1997 |
| WO | 99 42387 A | 8/1999 |

* cited by examiner

*Primary Examiner*—David T. Fidei
(74) *Attorney, Agent, or Firm*—Nixon & Vanderhye. P.C.

(57) ABSTRACT

This invention consists of a folding leaflet attached out of the cigarette packs and product packets in general, set to contain information of any kind, advertisements, promotion of new products, prize stamps, etc. Said leaflet is folded out of the packet in such a way that it shows on its external faces the same contents of the packet's external faces, therefore it results imperceptible at a glance.

14 Claims, 4 Drawing Sheets

FOLDING LEAFLET FOR CIGARETTE AND OTHER PRODUCT PACKETS

This application is the U.S. national phase of international application PCT/IT00/00054 filed 21 Feb. 2000, which designated the U.S.

TECHNICAL FIELD

This invention relates to the technical sector of the packaging and the production of packets set to contain different types of products and particularly cigarettes. It consists of a packet designed in such a way as to contain a considerable amount of information in order to satisfy the increasing need to inform users about the characteristics of the products and other subjects principally concerning health.

BACKGROUND ART

The present invention consists of a folding leaflet for product packaging in general, particularly but not restrictively appropriate for cigarette packs.

It's a real need to add to the packets of products an increasing number of information that may refer to the contents, the ingredients whether food is concerned, warnings on use and dangers, information concerning prize contests and collection of stamps or shopping cheques, warnings on procedures of use and side effects whether medicines are concerned, the presentation of the range of other items proposed by the manufacturer or information of different kind, comprising the promotion of advertising campaigns for educational and social purposes (like Public Service advertising).

Said need is partly due to law-enforcement and partly due to sale and advertising strategies that make use of the product, considering it an effective image means to communicate with consumers and give them information of different kind, either closely relative to the product or far from it.

In order to satisfy this need, writings are put on all the free surfaces of the packets, but often, for reasons of space, cards or leaflets with supplementary information are inserted inside the same packets.

In particular, people know brochures inserted inside packets of cakes or other food products, normally placed over the cakes or at the bottom of the packet.

In addition, people know informative or folding coupons, inserted inside cigarette packs, which must be extracted to be read once the packet is open. People know also the explanatory sheets of paper inside medicine packets that pharmacists and consumers must extract in order to read the procedure of use and the side effects.

Said brochures or coupons have the drawback of being physically separated by the packet, even if they are contained in it, consequently they fill not only a further space inside the packet, but they are even normally thrown away without being read, anyway they may be wasted.

In order to avoid these drawbacks, other informative or advertising brochures, which are stuck on the external surface of the packets, are known. Nevertheless, even said brochures have the drawback of covering part of the packet, preventing people from seeing the writings and drawings that it contains, as well as damaging the packet also from an aesthetic point of view.

DISCLOSURE OF INVENTION

The present invention principally aims at eliminating the above-mentioned and other drawbacks, supplying a folding leaflet for product packets and particularly for cigarette packs, which is perfectly integrated with the packet and neither covers nor damages it.

The advantages resulting from the present invention essentially consist of the fact that it's possible to supply a product packet with an attached leaflet, which results absolutely invisible; that the figure of the packet is not altered, consequently trademarks or writings are not erased; that the leaflets are attached to the packet but do not preclude the reading of what it carries on its surfaces; that they can be successively separated from the packet; that they can hold a considerable amount of supplementary information relative or not to the product; that they can show advertising or educational information as well as information of other kind.

Reduced to its essential structure and with reference to the figures of the enclosed drawings, a leaflet for product packets according to the invention, comprises:

- means to hold information, with a folding leaflet constituted by one or more faces (2, 3, 4, 5), everyone possibly carrying writings, drawings, photos or other figures;
- means to fix this leaflet out of the packet, by attaching it along an edge (14 or 13) of the packet or by sticking one of its surfaces (2) on the corresponding surface (7) of the same packet;
- means to fold the leaflet out of the packet, with an "accordion" shape that lets at least one face (2 or 3; or 3 and 4; or 3 and 4 and 5) of the leaflet overlap at least one face (7 or 6) of the packet.

Conveniently, in the case that a face of the leaflet is stuck on a face of the packet (for example face 2 stuck on face 7), the face that folds over the packet can be just the one (3) that continues across the edge (13) where it's stuck.

Conveniently, even in the case the leaflet is attached to an edge (14) of the packet, the face that folds over the packet can be just the one (2) that continues across the edge (14) where it's attached.

Conveniently, the faces of the leaflet that can be folded are more than one, so as to hold a greater amount of information.

Conveniently, each face of the leaflet has the same surface and sizes as the face of the parallelepiped packet where it is folded.

Conveniently, with reference to FIG. 1, the face (2) of the leaflet has the same sizes as the face (7) of the packet, while the face (3, 4, 5) has the same sizes as the face (6) of the packet.

Conveniently, the front face of the leaflet may have reduced sizes in height or width compared with the face (7) of the packet and, particularly, reach the height of the line over which the packet opens.

Conveniently, when the leaflet is folded, its external visible faces present the same graphic shape and contents as the faces of the packet they overlap, so that, once folded, the leaflet results imperceptible at a glance.

Conveniently, any parallelepiped packet comprising a packaging in paper or similar synthetic material (for example cellophane, polythene and the like), is equipped with a folding leaflet attached to it along one of its edges, by inserting a flap of the leaflet inside the packet or as an extension of the packet itself.

Conveniently, any parallelepiped packet comprising a packaging in paper or similar synthetic material (for example cellophane, polythene and the like), is equipped with a folding leaflet having a surface stuck on the corresponding surface of the packet itself.

Conveniently, with reference to FIGS. 1 and 5, a cigarette pack, either stiff or soft, is equipped with a folding leaflet attached to it along the edge (14), by inserting a flap of the leaflet inside the packet or as an extension of the packet itself.

Conveniently, with reference to FIG. 4, a cigarette pack, either stiff or soft, is equipped with a folding leaflet having a surface (2) stuck on the corresponding surface (7) of the packet itself.

Conveniently, with reference to FIG. 1, the leaflet is folded on the packet by overlapping face (2) over face (7) of the packet so that the external face (2A) results visible; then face (3) is folded towards left around edge (17), while face (4) is folded towards right around edge (15) and face (5) is folded again towards left around edge (16), in such a way that the external face (5A) results visible.

Conveniently, with reference to FIGS. 2 and 3, the faces folded in the above-stated way, may be even just three (2, 3, 4) or two (2, 3).

Conveniently, the invention (1) may present, at the connecting edge, or in other points, a dotted line, allowing the user to remove the leaflet from the packet and hold and/or use it separately.

Conveniently, this invention may be realized either simultaneously with manufacturing of the packet or separately from it and later attached to it.

Conveniently, this invention (1) is realized in paper or other printable material.

Conveniently, the packet over which the leaflet is attached is later covered by cellophane or other material that prevents the leaflet from moving and protects at once the packet itself. Conveniently, the leaflet may be fixed to the packet even with other means, for example by attaching a sticky label to the folding point in order to prevent it from accidentally opening.

In practice, the manufacturing details may, however, vary as regards shape, size, position of elements, and type of materials used, but still remain within the range of the idea proposed as a solution and, consequently, within the limits of the protection granted by this patent for invention.

BRIEF DESCRIPTION OF DRAWINGS

The attached drawings are practical examples of the invention, but are not to be considered restrictive.

Figure 1:
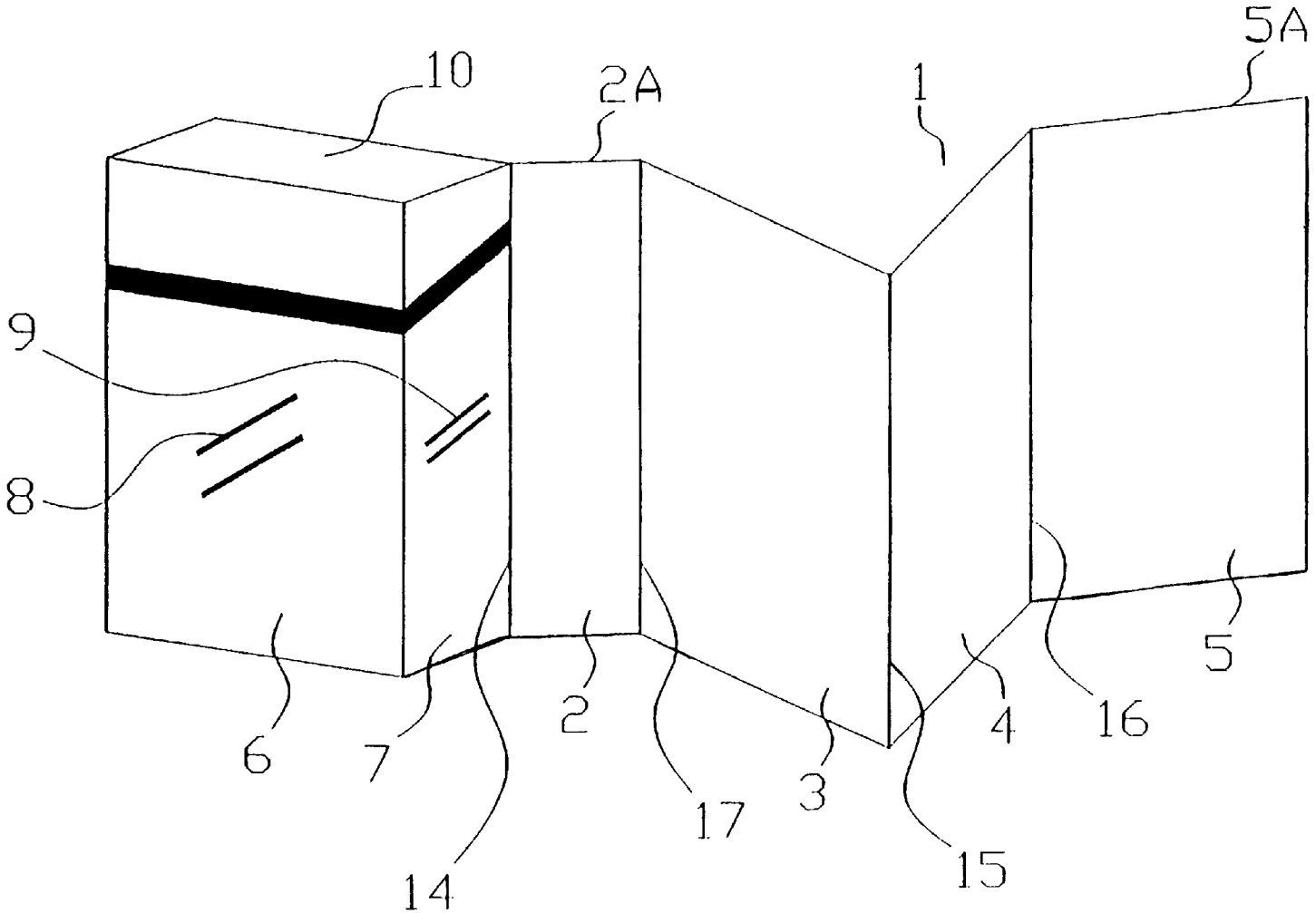
FIG. 1 shows a perspective view of the invention (1) applied to a stiff pack of cigarettes (10). The invention is constituted by four folding faces, separated by folding points (17, 15, 16), of which the former (2) has the same sizes as the packet's side surface (7), while the others (3, 4, 5) have the same sizes as the packet's front surface (6), since the leaflet is attached to the packet along its edge (14). When the leaflet is folded, the external faces 2A (opposite to face 2) and 5A (opposite to face 5) result visible and carry the same writings and drawings (8, 9) that may be depicted on faces 7 and 6 of the packet, in such a way that the leaflet results imperceptible at a glance and the packet is not altered.
Figure 3:
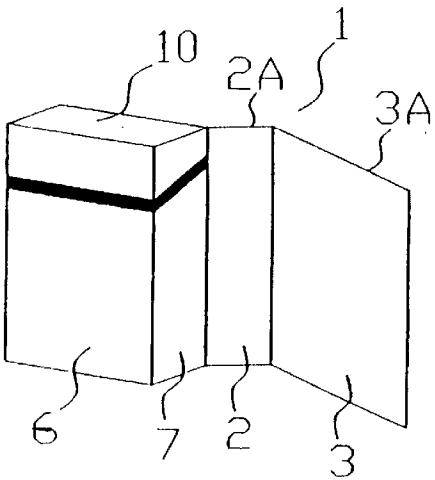
FIG. 3 shows the same invention (1) as FIG. 1 still applied to a stiff pack of cigarettes (10) with the leaflet formed by two faces (2, 3) in such a way that, once folded, faces 2A (opposite to face 2) and 3A (opposite to face 3) result respectively visible over faces 7 and 6.
Figure 2:
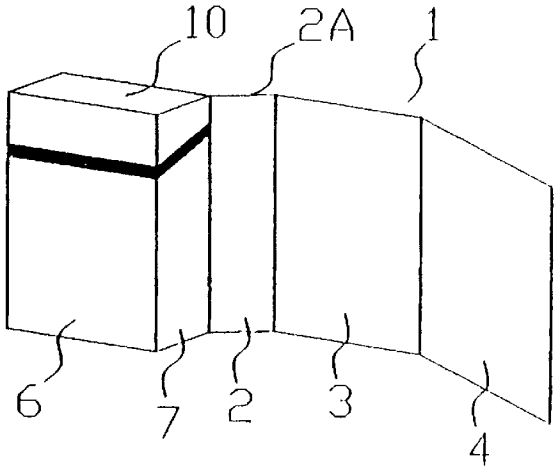
FIG. 2 shows the same invention (1) as FIG. 1 still applied to a stiff pack of cigarettes (10) with the leaflet formed by three faces (2, 3, 4) in such a way that, once folded, faces 2A (opposite to face 2) and 4 result respectively visible over faces 7 and 6.
Figure 4:
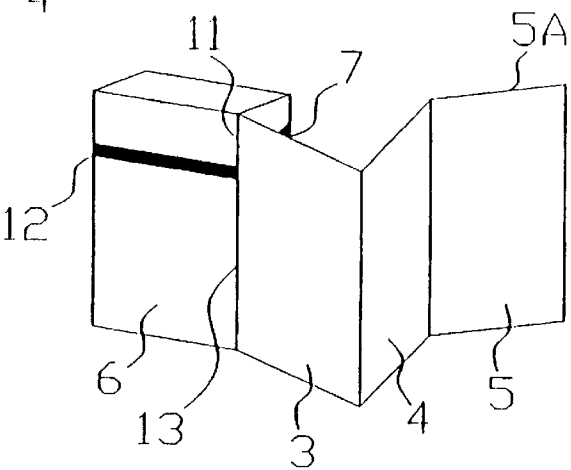
FIG. 4 shows the same invention (1) as FIG. 1 still applied to a stiff pack of cigarettes (10), but in this case having surface (2) stuck on packet's face (7); in this way, the leaflet folds around edge (13) and its upper part (11), extending over the opening line (12), is unstuck from said edge so as to permit to open the packet. In this case, the leaflet is formed by three faces (3, 4, 5) in such a way that, once folded, face 5A (opposite to face 5) results visible over face 6.
Figure 5:
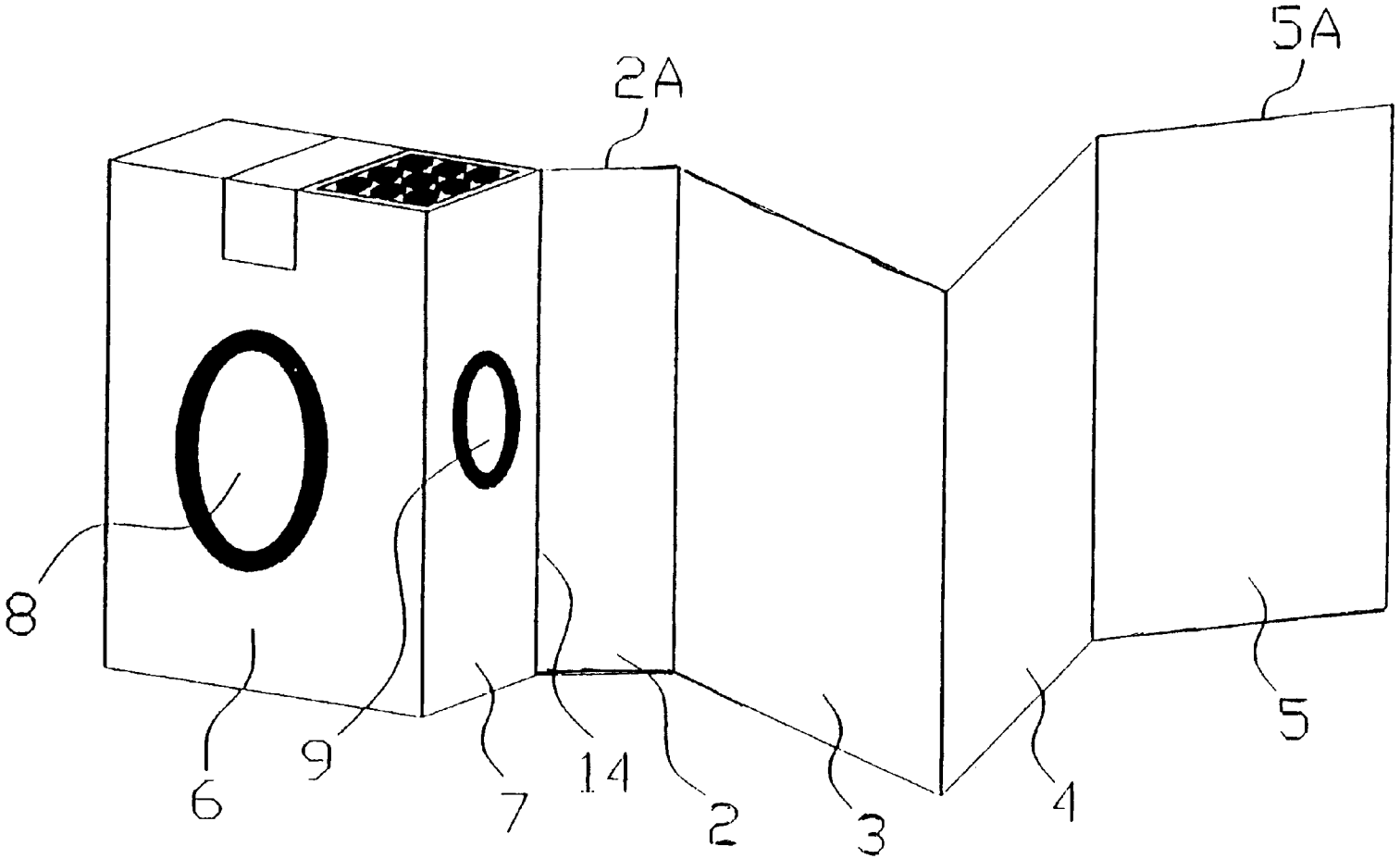
FIG. 5 shows the same invention as FIG. 1 applied to a soft pack of cigarettes, over which the leaflet may be fixed, as depicted in the drawing, by attaching it along the edge (14) or by sticking its face (2) on face (7). Even in this conformation, the invention is constituted by four folding faces, of which the former (2) has the same sizes as the packet's side surface (7), while the others (3, 4, 5) have the same sizes as the packet's front surface (6); in this way, when the leaflet is folded, the external faces 2A (opposite to face 2) and 5A (opposite to face 5) result visible and carry the same writings and drawings (8, 9) that may be depicted on faces 7 and 6 of the packet.
Figure 7:
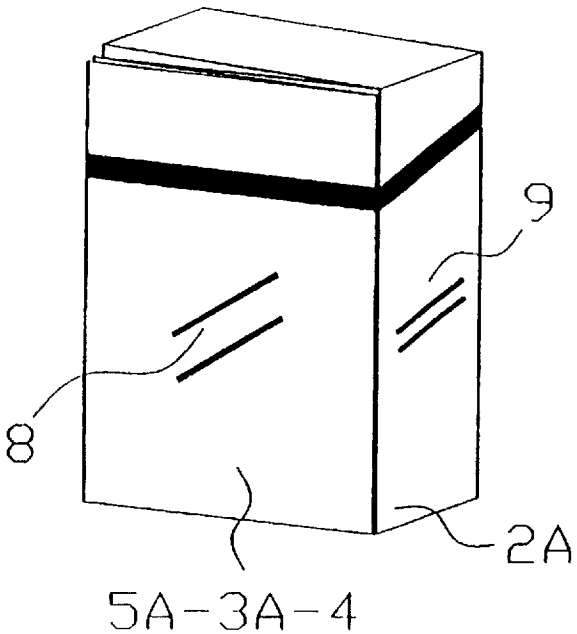
FIG. 7 shows a perspective view of the stiff pack of cigarettes with the leaflet folded on it, so that faces (2A) and (5A or 3A or 4) result visible and carry the same writings and drawings (8, 9) depicted on the non-visible faces (6, 7) of the packet.
Figure 6:
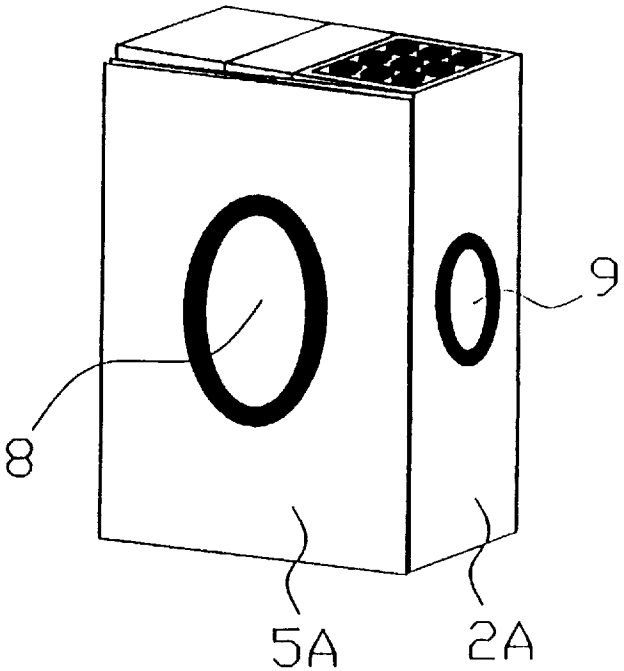
FIG. 6 shows a perspective view of the soft pack of cigarettes with the leaflet folded on it, so that faces 2A and 5A result visible and carry the same writings and drawings (8, 9) depicted on the non-visible faces (6, 7) of the packet.

The above-depicted drawings, presented as practical but not restrictive examples, refer to cigarette packs, but this invention may be applied to packets of products of any kind and size.

What is claimed is:

1. A leaflet attached at the outer walls of a packet, the packet including a main wall having a first external face and an adjacent wall having a second external face, the first and second external faces having respective graphic reproductions, said leaflet comprising:

one or more primary sheets carrying information, said primary sheets having a same shape and size and being folded one above the other; and a secondary sheet attached to said adjacent wall of the packet, wherein the primary sheets have the same shape and size of said packet main wall and wherein said primary sheets have sizes greater than said secondary sheet, a primary sheet external face and a secondary sheet external face carrying the same graphic reproductions respectively of the first and second external faces.

2. A leaflet according to claim 1, wherein said secondary sheet has a same shape and size of the packet adjacent wall.

3. A leaflet according to claim 1, wherein a dotted break line is formed between an inner sheet of said primary sheets and said secondary sheet.

4. A box package including a packet and a leaflet according to claim 1.

5. A box package according to claim 4, wherein said leaflet has a surface stuck on a corresponding surface of the packet.

6. A box package according to claim 5, wherein said leaflet is attached by sticking said secondary sheet to the adjacent wall of the packet.

7. A box package according to claim 4, wherein said leaflet is retained in place on said packet in a closed condition by an envelope of transparent film surrounding said packet and said leaflet.

8. A box package according to claim 4, wherein said leaflet is retained in place on said packet in a closed condition by a sticky label between an outer sheet of said primary sheets and said packet.

9. A box package according to claim 4, wherein said primary sheets are superimposed to the packet main wall carrying an opening mouth.

10. A box package according to claim 4, wherein said primary sheets are superimposed to a wall opposed to the main wall carrying an opening mouth.

11. A box package according to claim 4, wherein said packet has a parallelepiped shape.

12. A box package according to claim 4, wherein said packet is a cigarette packet.

13. In combination a packet and a foldable leaflet attached to the packet, (1) the packet comprising:

a main wall having a first external face and an adjacent wall having a second external face, and graphic reproductions displayed on the first and second external faces, (2) the foldable leaflet comprising:

a plurality of primary sheets each of a same shape and size and being folded one above the other, and a secondary sheet attached to the adjacent wall, wherein each of the primary sheets is shaped and sized to match a shape and size of the packet main wall and positioned such that when the primary sheets are folded, the primary sheets are superimposed on the packet main wall, and wherein an outside face of a last of the primary sheets and an outside face of the secondary sheet comprise the same graphic reproductions respectively of the packet first and second external faces.

14. In combination a packet and a leaflet attached to the packet, (1) the packet comprising:

a main wall having a first external face and an adjacent wall having a second external face, and graphic reproductions displayed on the first and second external faces, (2) the leaflet comprising:

at least one primary sheet, and a secondary sheet integrated with the at least one primary sheet and attached to the adjacent wall, wherein the primary and secondary sheets do not form a part of the packet, wherein the primary sheet is shaped and sized to match a shape and size of the packet main wall and positioned such that when the primary sheet is folded against the packet main wall, the primary sheet is superimposed on the packet main wall, and wherein an outside face of the primary sheet and an outside face of the secondary sheet comprise the same graphic reproductions respectively of the packet first and second external faces.

* * * * *